United States Patent [19]

Houser

[11] 4,185,553

[45] Jan. 29, 1980

[54] DEVICE FOR DISTINGUISHING A SINE-WAVE SIGNAL FROM AN INCREASE IN BACKGROUND NOISE

[75] Inventor: Wesley G. Houser, State College, Pa.

[73] Assignee: The United States of America as represented by the Secretary of the Navy, Washington, D.C.

[21] Appl. No.: 267,902

[22] Filed: Mar. 22, 1963

[51] Int. Cl.[2] ..... F42B 22/04

[52] U.S. Cl. ..... 102/18 R; 340/171 R; 367/135

[58] Field of Search ..... 102/19.2, 70.2, 70.2 P, 102/18, 18 R; 340/5, 6, 171; 321/10

[56] References Cited

U.S. PATENT DOCUMENTS

| | | | |
|---|---|---|---|
| 2,113,148 | 4/1938 | Weber | 340/171 |
| 2,237,899 | 4/1941 | Bjornson | 181/0.52 |
| 2,368,953 | 2/1945 | Walsh | 340/5 |
| 3,131,264 | 4/1961 | Chittleburgh et al. | 340/171 |

*Primary Examiner*—Charles T. Jordan
*Attorney, Agent, or Firm*—R. S. Sciascia; Henry Hansen

EXEMPLARY CLAIM

3. In a mine, having an exploding mechanism capable of detecting underwater acoustical sine-wave frequency signals emitted by a large moving vessel in the presence of broad-band acoustical frequency signals present in the surrounding water, when said vessel is within the effective target distance of the mine, the combination comprising:

a hydrophone adapted to receive acoustical sine-wave frequency signals emitted by said large moving vessel and broad-band acoustical frequency signals present in the surrounding water;

a plurality of narrow band-pass contiguous filters connected to the output of said hydrophone, each of said filters tuned to adjacent portions of the frequency spectrum emitted by said vessel;

a plurality of rectifiers, one rectifier connected to the output of each of said filters, the polarity of each of said rectifiers being opposite to that of each of said rectifiers immediately adjacent thereto;

a plurality of summing means, one summing means connected to the output of each of said plurality of rectifiers, said plurality of rectifiers and said plurality of summing means so connected and so correlated as to cancel said broad-band acoustical frequency signals and to pass said sine-wave frequency signals emitted by said vessel; and a mine exploding mechanism connected to said plurality of summing means, whereby when a compound signal comprising a sine-wave acoustical frequency signal emitted by said vessel and a broad-band frequency signal is detected by said hydrophone, said broad-band frequency signal will be electrically cancelled and the electrical signal representing said acoustical frequency signal of said vessel will be transmitted to said mine exploding mechanism and actuate said mechanism of said mine.

5 Claims, 4 Drawing Figures

DEVICE FOR DISTINGUISHING A SINE-WAVE SIGNAL FROM AN INCREASE IN BACKGROUND NOISE

This invention relates to wave analyzers and in particular to wave analyzers capable of detecting, identifying, and indicating a sine-wave signal in the presence of broad-band noise.

The present invention is used in connection with the ultra-low frequency acoustics of ships and background noises in coastal harbor locations and mine actuation in the low-sonic and infra-sonic frequency range. In the naval protection of harbors it is frequently desirable to place fixed mines in the path of incoming vessels and to arm these mines so that they will explode upon reception of a low-sonic or infra-sonic frequency emitted by the passing vessel. Thus the acoustic vibrations of the enemy vessel will detonate the mine when it is correctly positioned to sink the oncoming enemy ship. Large vessels in motion emit a relatively low frequency acoustical vibration. Hence it is essential that the device respond to such frequencies rather than the higher frequency spectrum emitted by smaller craft which are not the intended target of the mine.

One of the difficulties in the design of a system capable of detecting ship acoustics is the presence of broad-band noise created by the ocean itself. This broad-band noise may rise or fall depending upon the sea state, and other conditions. Broad-band noise is often of sufficient intensity to explode the mine, or to mask any sine-wave signals emitted by an approaching surface vessel so that under noisy conditions the mine might not respond when the target vessel is within range. Likewise if the broad-band noise of the ocean is of low intensity the mine may explode when the vessel is out of effective range.

It is, therefore, desirable to have a device which will detect low-level signals in the presence of an amplitude fluctuating broad-band noise. Such a device should be capable of being conveniently packaged in a mine case and be operable at the ultra-low frequency acoustic outputs of large surface vessels.

The present embodiment of this invention solves this problem of mine firing mechanisms and operates at frequencies as low as 2.0 cycles per second. The device consists of a series of contiguous filters each of which has a band width equal to about 5% of its center frequency and each of which has peak responses in the ultra-low frequency band. The center frequencies are arranged so that the responses of the adjacent filters overlap at the −6 decibel response points. When the input of the device is connected in parallel to an underwater hydrophone, each filter represents an active channel for processing signals of discrete frequencies. By appropriate rectification and eventual summing of all signals, the system is designed to respond to the strongest spectral line component present in the two-to-eight cycles per second spectrum. The method of summing of the signals is accomplished by having each alternate filter circuit equipped with a rectifier of like polarity and each adjacent filter circuit equipped with a rectifier of opposite polarity. Thus, first, third, fifth, etc. circuits transmit signals having a positive polarity and second, fourth, sixth etc. circuits transmit signals having a negative polarity. As may be seen, when the signals are ultimately summed, the electrical responses representing the broad-band noise are cancelled, and the responses representing a sine-wave signal or pure tone are indicated by the flow of current through the circuit. This flow of current may be directed to a relay connected to a firing device which explodes the mine.

The object of this invention, therefore, is to provide an acoustical device capable of detecting low-level sine-wave signals in the presence of a fluctuating broad-band noise.

Another object of this invention is to provide an electrical summing method whereby the effects of broad-band noise may be cancelled.

These and other objects of this invention will become apparent upon the careful consideration of the following description together with the accompanying drawings.

Figure 1:
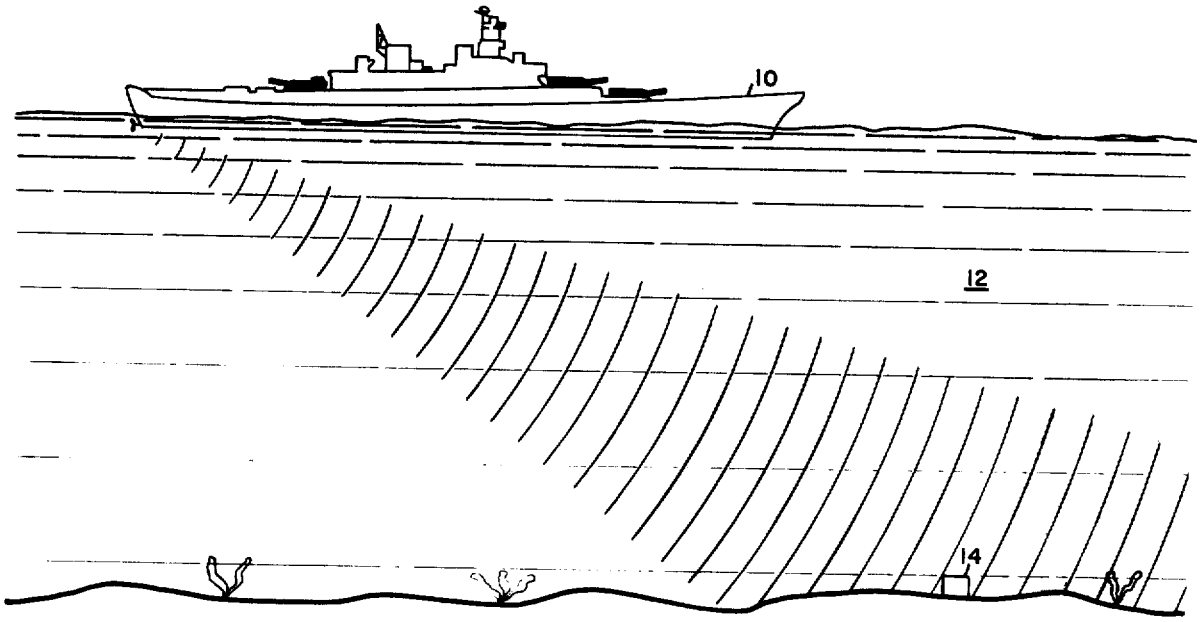
FIG. 1 is a representative drawing showing the positioning of a surface ship with a mine containing the embodiment of this invention.

Referring now to FIG. 1, there is depicted surface vessel 10 afloat in ocean 12 in the vicinity of mine 14 resting on the ocean bottom and containing the preferred embodiment of this invention.

Figure 2:
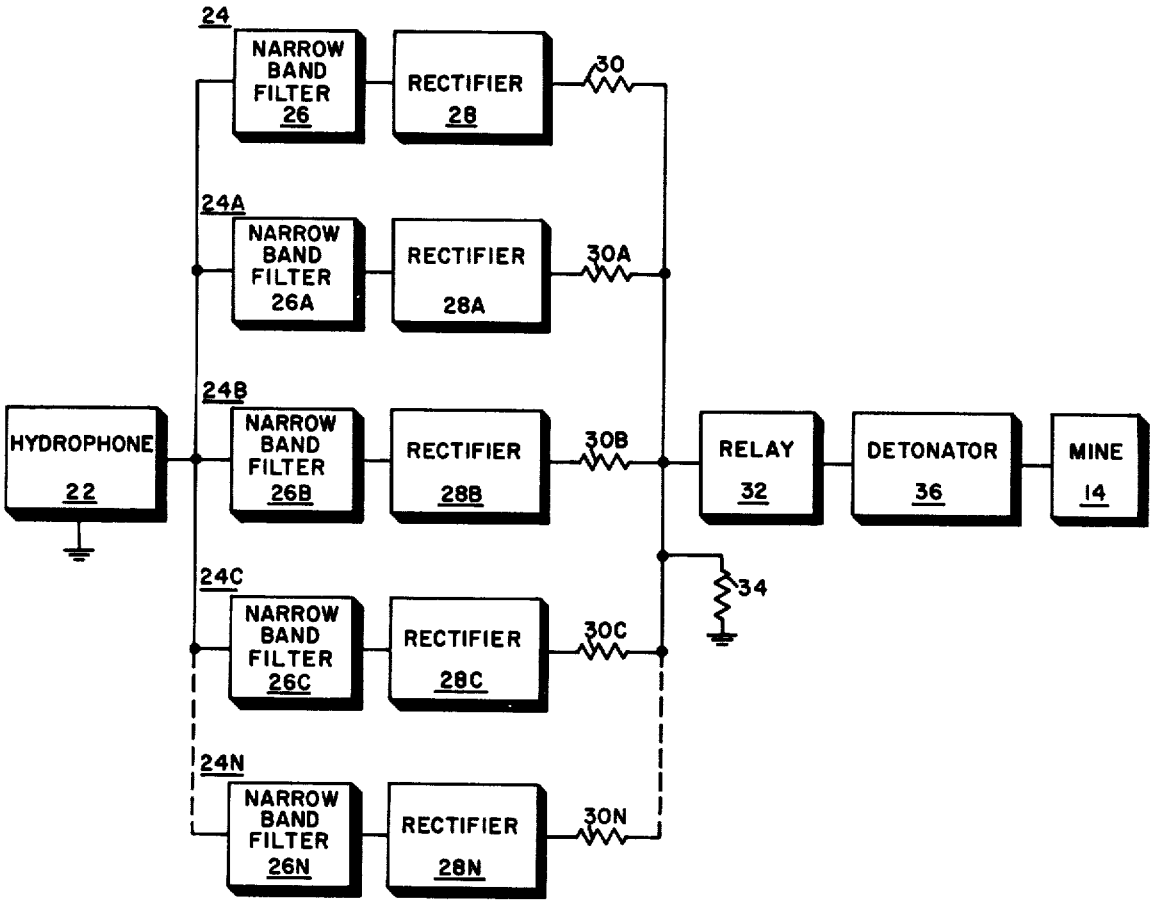
FIG. 2 is a block diagram of a preferred embodiment of this invention.

Referring now to FIG. 2, hydrophone 22 is positioned within mine 14, so as to receive acoustical vibrations through ocean 12 and is electrically coupled through a common connection to frequency circuits 24, 24A, 24B, 24C, . . . and 24N. Circuit 24N is used to indicate that the number of such circuits may be varied depending on the particular application made of the device. In this particular application fourteen such circuits were used. Each of these frequency circuits 24 is similar to the others and is comprised of a narrow-band filter 26, 26A, 26B, etc. electrically connected to a rectifier 28, 28A, 28B, etc. which is in turn connected through a summing resistors 30, 30A, 30B, etc. to an electronic gate relay 32 and through a ground load resistor 34 to ground. Relay 32 is connected to and actuates detonator 36 which explodes the mine 14. Relay 32 is a combination electronic gate and relay which permits only a signal of a predetermined amplitude to pass and which can be actuated only by signals equal to or greater than the predetermined amplitude. The rectifiers 28, 28A, 28B, etc. are biased in alternating polarity. Thus rectifiers 28 and 28B will permit only voltages of positive polarity to pass, whereas rectifiers 28A and 28C will permit only voltages of negative polarity to pass. Since the operation of the device depends upon the cancellation of the noise outputs from the rectifier circuits, an even number of channels, each comprised of a circuit 24 and a rectifier 28, must be present in the unit.

Figure 3:
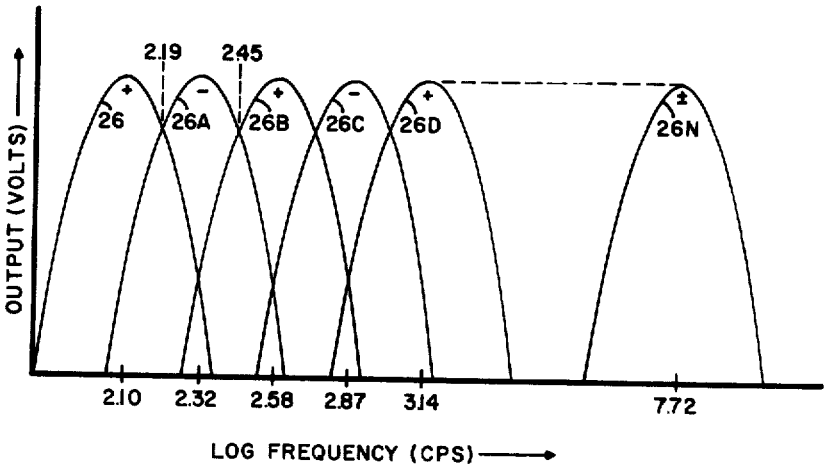
FIG. 3 is a graphical illustration of the broad-band frequency response of the filter circuits indicated on FIG. 2.

Referring now to FIG. 3, narrow-band filters 26, 26A, 26B, 26C, . . . 26N have sharply peaked characteristics as indicated, whereby each filter characteristic is directly contiguous to the one on either side of it. These filters each have a bandwidth equal to about 5% of the center frequency and each has a peak response on the very low frequency band.

In the preferred embodiment of this device fourteen frequency circuits 24 were used having the following filter center frequencies and corresponding crossover frequencies:

| Filter Center Log Frequency (cps) | -6db Crossover Log Frequency (cps) |
|---|---|
| 2.10 | 1.99 |
| 2.32 | 2.19 |
| 2.58 | 2.45 |
| 2.87 | 2.72 |
| 3.14 | 2.99 |
| 3.45 | 3.28 |
| 3.86 | 3.64 |
| 4.26 | 4.04 |
| 4.72 | 4.48 |
| 5.20 | 4.95 |
| 5.74 | 5.46 |
| 6.32 | 6.02 |
| 6.96 | 6.64 |
| 7.72 | 7.31 |
| | 8.09 |

The plus and minus signs associated with the individual filter characteristic indicate the polarity of voltage which the filter will pass.

It should be noted that the alternate polarity arrangement shown on FIG. 3 is but one possible method of inhibiting noise actuation. The only criterion for noise-free detection is that half of the number of circuits have the same polarity output. Other possible arrangements for the polarity of adjacent circuits 24, 24A, 24B, 24C, etc. are ++−−++−−, +−−++−+−, or −+++−−−+. Other combinations are possible and may be determined by referring to the anticipated frequency of the vessel for which the mine is intended.

In operation, vessel 10 emits acoustical vibrations which proceed through the ocean 12 until they reach mine 14. The vibration reaching the mine is composed of a broad-band sea state noise, which depends on the condition of the water at that time, and the acoustical vibration emitted by the vessel 10. In general, this large vessel-emitted vibration consists of a number of sine-wave or pure tone frequencies ordinarily in the ultra-low acoustical frequency range of, say two or more cycles per second. This acoustical vibration and the sea state noise comprising a broad-band system are converted to electrical impulses of an alternating character by hydrophone 22 and transmitted to narrow-band filters 26, 26A, 26B, etc. The sea state noise is generally of constant amplitude throughout its frequency spectrum and hence, produces approximately equal hydrophone signals throughout its entire spectrum. These voltages are passed by filters 26 and 26A as A.C. voltages. As may be seen, circuit 24 will transmit only the alternating characteristics of a positive polarity through rectifier 28, whereas circuit 24A will conduct only the negative characteristics of the impressed voltage. These two voltages are summed through summing resistors 30 and 30A and in the case of sea state noise, so that the cathod is connected to coupling capacitor 58.

A twin "T" selective filter 62 is connected between terminal 1 and the anode of diode 60. This filter comprises two parallel connected legs, connected between terminal 1 and the anode of diode 60. One of the legs comprises series connected capacitors 64 and 66, the other of the legs comprises series connected resistors 68 and 70. Capacitor 72 is connected between resistors 68 and 70 and terminal 2. Terminal 2 is also connected through resistor 74 to a point between capacitors 64 and 66. The output of diode 60 is then coupled to terminal 2 through parallel connected capacitor 76 and resistor 78, which serve as a conventional filter unit to convert pulsating current to steady direct current. The output of diode 60 is then connected through resistor 30 to the relay 32 as is shown in FIG. 2.

In operation, the embodiment of this invention depicted in FIG. 4 functions as follows: hydrophone 22 receives acoustic impulses comprising ambient noise from the ocean and a pure tone signal produced by an oncoming vessel 10, and converts them to alternating voltages. These voltages are conducted through terminals 1 and 2 through resistor 38 and coupling capacitor 40, to the base of transistor 42. Transistor 42 and its accompanying circuit form an emitter follower device designed to match impedances. This device in effect is a current amplifier. The amplified alternating impulses from transistor 42 are tapped from the emitter and conducted through coupling capacitor 48 to the base of transistor 50 which serves as a common emitter voltage amplifier. The alternating voltages entering the base and transmitted through the collector of transistor 50 are phase shifted 180°. These 180° phase shifted voltage impulses pass through coupling capacitor 58 and on to diode 60.

The same 180° out-of-phase impulses are transmitted to selective ultimately cancel each other. The same process occurs between circuits 24B, 24C, etc. However, the low-frequency acoustical vibration emitted by ship 10 to which, say narrow-band filter 26A is tuned, will not be cancelled but will proceed through circuit 24A as a negative voltage signal. This electrical signal actuates relay 32 which in turn causes detonator 36 to explode mine 14.

Figure 4:
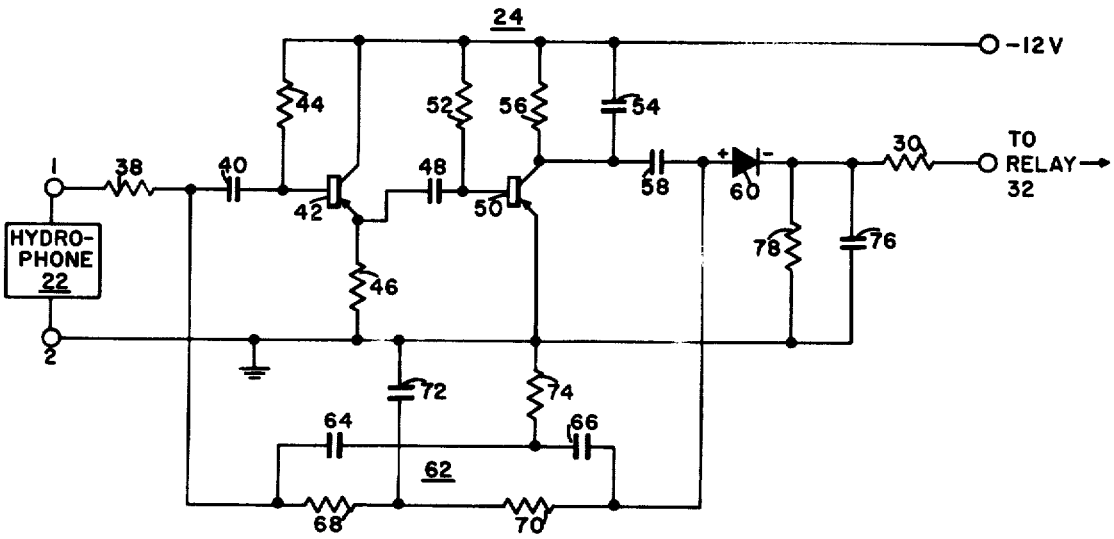
FIG. 4 is a detailed circuit diagram of a single filter and rectifier circuit shown in FIG. 2.

Referring now to FIG. 4, a schematic diagram shows an embodiment of a single circuit 24 diagrammatically shown in FIG. 2, which proved to be particularly successful when used in conjunction with low-frequency detection. As in FIG. 2, there is shown hydrophone 22 having terminals 1 and 2 electrically connected to narrow-band filter 26. Terminal 1 of hydrophone 22 is connected through summing resistor 38 through coupling capacitor 40 to the base of transistor 42 which serves as an emitter follower and impedance matching device. The base terminal of transistor 42 is connected through bias resistor 44 to a source of −12 volts and the collector terminal connected directly to this source of negative voltage. Terminal 2 of hydrophone 22 serves as a grounded connector through the circuit 24. The emitter terminal of transistor 42 is connected through bias resistor 46 to terminal 2 and is also connected through coupling capacitor 48 to the base of transistor 50 which serves as the basis of a common emitter amplifier circuit. Bias resistor 52 is connected from the base of transistor 50 to the source of −12 volts. Collector terminal of transistor 50 is likewise connected to this negative voltage through parallel connected capacitor 54 and load resistor 56. The emitter terminal of transistor 50 is coupled to terminal 2. Collector terminal of transistor 50 is coupled through coupling capacitor 58 to the anode of diode 60 which serves as the basis of the rectifier 28. It should be noted that diode 60 is positioned in the circuits 24 and 24B with the polarity previously described. However, in circuits 24A and 24C the polarity is reversed filter 62 which is tuned to offer very high impedance to the frequency at which narrow-band filter 26 is turned, and low impedance to other frequencies. Hence, frequencies other than those to which the filter 26 is tuned are fed back to the input of capacitor 40 and being 180° out-of-phase with the incoming signals from terminal 1, cancel them. Those frequencies at the tuned frequency of filter 62 meet very high impedance and hence do not feed back and cancel the input from terminal 1. Thus these passes frequencies are selectively amplified by the common emitter amplifier and proceed to diode 60.

The amplified alternating voltages from the transistor 50 are rectified by diode 60 so that only positive fluctuations are allowed to pass. These are changed to pulsating direct current impulses by the filter comprised of capacitor 76 and resistor 78 and pass on to relay 32 designed to pass voltages which are above a predetermined amplitude to detonator 36.

Thus, as may be seen, the presented embodiment of this invention operates effectively in all levels of sea state. Hence, the danger of high or low sea state noise exploding the mine 14 is eliminated. The device is tuned by means of filters 26, 26A . . . to be activated only by larger vessels which produce ultra-low vibration. The mine 14 will not respond to smaller vessels for which the mine was not intended.

It should be noted that although this particular embodiment of the invention is described as having use in the low-frequency acoustical range, it is contemplated that it is useful in all audio and radio frequency ranges as well as in applications related to mines. In such applications, the number of circuits 24 can be increased or decreased and the response characteristics of the filters and rectifiers varied. This invention has been described with a certain degree of particularity, it is to be understood however, that the present disclosure has been made only by way of example and that numerous changes in the details and construction, and the combination and arrangement parts may be resorted to without departing from the spirit and scope of the invention as hereinafter claimed.

I claim:

1. A frequency analyzing device for detecting a sine-wave signal in the presence of a broad-band frequency signal comprising, in combination:

an even plurality of frequency selective circuits connected so as to have a common input for the reception of signals to be analyzed, the frequency characteristic of each of said circuits being contiguous to the next adjacent circuit so that the upper frequency limit of each of said circuits substantially overlaps the lower frequency of the next adjacent circuit;

each of said circuits comprising a narrow-band filter connected to said common input for the reception of signals, each of said narrow-band filters comprising a summing circuit, an impedance matching circuit connected to said summing circuit, and an emitter amplitude circuit connected to said impedance matching circuit;

an even plurality of rectifier circuits, one of said rectifier circuits connected to the output of each of said narrow-band filters, the polarity of each of said rectifier circuits being opposite to the polarity of each of said rectifier circuits immediately adjacent thereto; and summing means connected to each of said rectifier circuits, said summing means connected to a common output circuit, whereby when a compound signal comprising a sine-wave signal and a broad-band frequency signal is impressed upon said common input, said broad-band frequency signal portion of said compound signal will be electrically cancelled, and only that portion of said compound signal representing said sine-wave signal will be transmitted to said common output circuit as a direct current signal.

2. The combination as set forth in claim 1 wherein, each of said rectifier circuits comprises a diode circuit and a low-pass filter connected to the output of said diode circuit.

3. In a mine, having an exploding mechanism capable of detecting underwater acoustical sine-wave frequency signals emitted by a large moving vessel in the presence of broad-band acoustical frequency signals present in the surrounding water, when said vessel is within the effective target distance of the mine, the combination comprising:

a hydrophone adapted to receive acoustical sine-wave frequency signals emitted by said large moving vessel and broad-band acoustical frequency signals present in the surrounding water;

a plurality of narrow band-pass contiguous filters connected to the output of said hydrophone, each of said filters tuned to adjacent portions of the frequency spectrum emitted by said vessel;

a plurality of rectifiers, one rectifier connected to the output of each of said filters, the polarity of each of said rectifiers being opposite to that of each of said rectifiers immediately adjacent thereto;

a plurality of summing means, one summing means connected to the output of each of said plurality of rectifiers, said plurality of rectifiers and said plurality of summing means so connected and so correlated as to cancel said broad-band acoustical frequency signals and to pass said sine-wave frequency signals emitted by said vessel; and a mine exploding mechanism connected to said plurality of summing means, whereby when a compound signal comprising a sine-wave acoustical frequency signal emitted by said vessel and a broad-band frequency signal is detected by said hydrophone, said broad-band frequency signal will be electrically cancelled and the electrical signal represented said acoustical frequency signal of said vessel will be transmitted to said mine exploding mechanism and actuate said mechanism of said mine.

4. The combination as set forth in claim 3 wherein said mine exploding mechanism comprises a gate relay device.

5. The combination as set forth in claim 4 wherein said gate relay device is connected to an exploder to be activated by said relay device, and said mine is to be activated by said exploder when said sine-wave acoustical frequency signal of said vessel is detected by said hydrophone.

* * * * *